United States Patent [19]

Wyatt

[11] Patent Number: 4,555,105

[45] Date of Patent: Nov. 26, 1985

[54] METHOD AND APPARATUS UTILIZING MAGNETICALLY COUPLED ROLLERS TO FEED SHEETS

[75] Inventor: Kenneth L. Wyatt, Oklahoma City, Okla.

[73] Assignee: AT&T Technologies, Inc., New York, N.Y.

[21] Appl. No.: 485,147

[22] Filed: Apr. 15, 1983

[51] Int. Cl.[4] ..... B65H 3/06; B65H 5/06

[52] U.S. Cl. ..... 271/264; 271/901; 271/117; 271/152; 271/193; 198/789

[58] Field of Search ..... 271/DIG. 3, 264, 117, 271/126, 265, 152, 153, 154, 193, 109, 901; 198/690, 789, 722; 414/118, 122, 123

[56] References Cited

U.S. PATENT DOCUMENTS

| | | | |
|---|---|---|---|
| 3,256,570 | 6/1966 | Kaino | 19/272 |
| 3,263,797 | 8/1966 | Lutes | 198/789 |
| 3,306,491 | 2/1967 | Eisner et al. | 271/117 |
| 3,428,308 | 2/1969 | Bernard | 271/193 |
| 4,103,769 | 8/1978 | Jorgensen | 198/789 |

FOREIGN PATENT DOCUMENTS

| | | | |
|---|---|---|---|
| 2219912 | 10/1973 | Fed. Rep. of Germany | 271/265 |
| 0008595 | 1/1979 | Japan | 271/264 |
| 2017655 | 10/1979 | United Kingdom | 271/901 |

OTHER PUBLICATIONS

IBM Tech. Disc. Bull. "Sheet Feeding Apparatus" vol. 19 No. 7, Dec. 1976, Fallon et al. pp. 2440–2441.

*Primary Examiner*—Douglas C. Butler
*Assistant Examiner*—James E. Barlow
*Attorney, Agent, or Firm*—R. P. Miller; M. de Picciotto

[57] ABSTRACT

Sheets 12 are fed one at a time from a stack 11 by a freely mounted roller 13 magnetically coupled to a rotating drive roller 14. As the stack is depleted, an elevator 27 is operated to maintain the top sheet in contact with the roller 13.

15 Claims, 3 Drawing Figures

POWER SOURCE

METHOD AND APPARATUS UTILIZING MAGNETICALLY COUPLED ROLLERS TO FEED SHEETS

TECHNICAL FIELD

This invention relates to methods and apparatus for feeding sheets through the agency of a pair of magnetically coupled rollers and more particularly to driving one roller to rotate the other magnetically coupled roller which in turn bears against and feeds sheets from a stack or along a path.

BACKGROUND OF THE INVENTION

In many diverse industries, there are needs to feed sheets, strands or laminates from a supply to a utilization device or along a path from one utilization device to a succeeding utilization device. One common practice contemplates the use of rollers that are spring-urged and positively driven to engage and feed the sheets. In certain instances, a single spring-urged roller resting on a stack of sheets may be driven to peel the sheets one at a time from the supply stack. In other instances a pair of rollers are spring-urged together, and one roller is positively driven so that a sheet placed in the nip between the rollers is advanced between the rollers.

The use of spring-urged rollers may be eliminated by establishing a magnetic force acting to hold the rollers together while one roller is driven so that a sheet placed between the rollers is advanced therethrough. In British Pat. No. 2,017,655, issued to the Xerox Corporation, Rochester, N.Y. and published Oct. 10, 1979, there is disclosed a sheet-feeding device comprising a pair of vertically aligned rollers that are spring-urged apart by a spring. One of the rollers is electrically magnetized to draw the rollers together while the other roller is positively driven so that a sheet placed or advanced into the roller nip is frictionally driven between the rollers.

Permanent magnets have been used to hold vertically aligned rollers together while material is advanced between the rollers. An example of such an arrangement is shown in U.S. Pat. No. 3,256,570, issued June 21, 1966, to I. Kaino where two series of rollers in a textile drafting machine are magnetically held in abutting relation while textile strands are drawn between the rollers.

There is still a need to provide a roller-feed device which is the essence of simplicity, and is capable of eliminating the danger of nipping the fingers or clothing of an attending operator.

SUMMARY OF THE INVENTION

This invention contemplates, among other things, methods and apparatus utilizing a pair of magnetically coupled rollers, wherein one roller is positively driven to frictionally drive the other roller which engages and feeds a sheet or a strand.

More particularly, in one application of the invention, a top sheet of a stack of sheets is engaged by a first roller constructed of paramagnetic material. A second positively driven roller that is magnetized, engages and frictionally rotates the first roller which in turn frictionally advances the top sheet from the stack. The arrangement is such that the second roller is spaced from the sheet stack, and the first roller is constructed with a diameter exceeding the spacing between the periphery of the second roller and the top sheet in the stack. As the sheets are fed from the stack, the first roller drops to follow the height of the remaining stack, but is magnetically held to the driving second roller so that successive sheets are fed from the stack.

With the afore-arrangement, the axis of the first roller is spaced offset with respect to a vertical line running orthogonally from the top sheet through the axis of the second roller. If an attending operator's finger or clothing is caught in the nip between the rollers, the magnetically held roller will readily separate thus avoiding injury to the operator.

BRIEF DESCRIPTION OF THE DRAWING

Other advantages, objects and features of the invention will be more apparent upon consideration the following detailed description in conjunction with the drawing wherein.

DETAILED DESCRIPTION OF THE INVENTION

Figures 1, 2, 3:
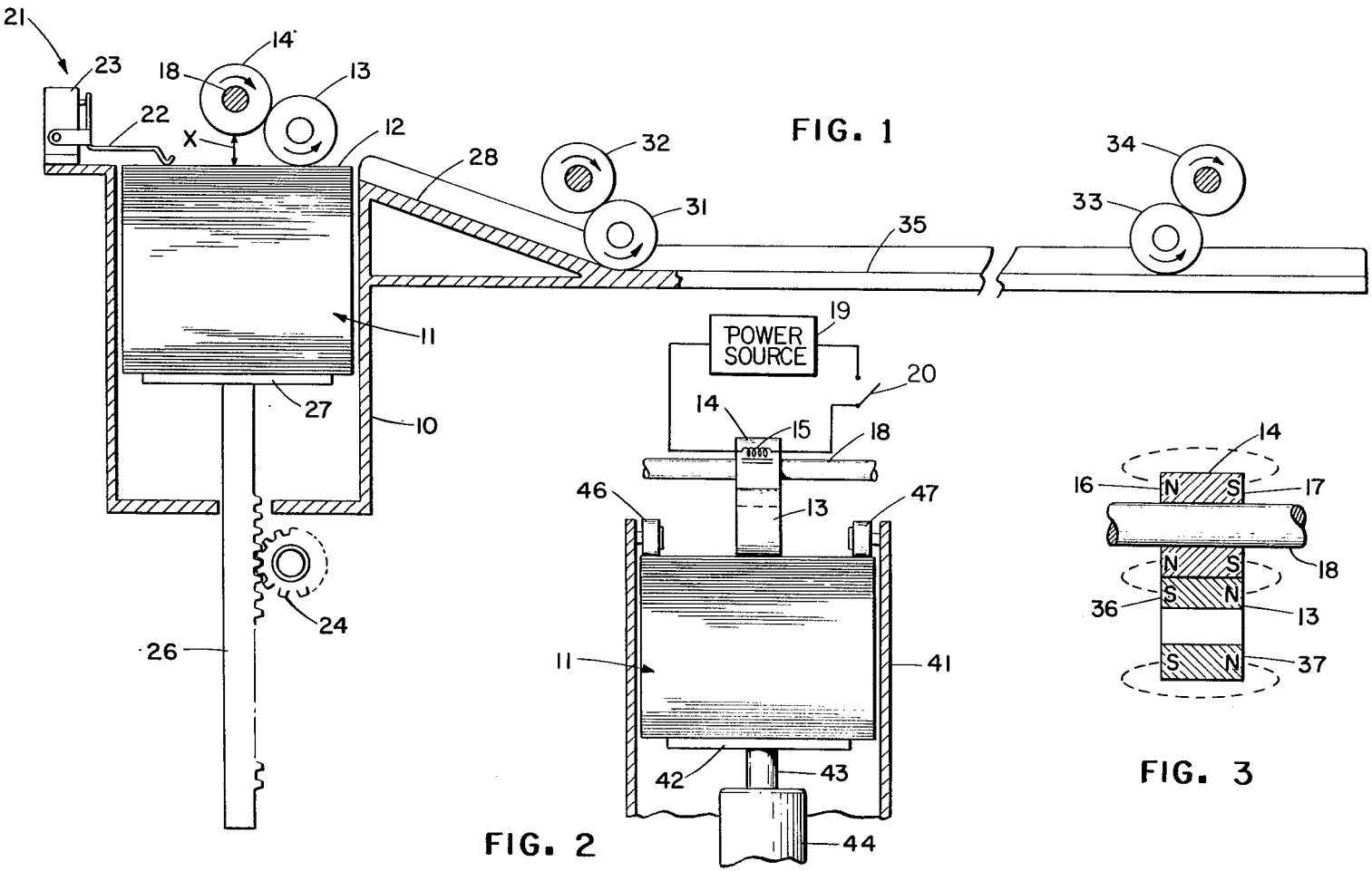
FIG. 1 is a side schematic view of an apparatus having magnetically coupled rollers for feeding sheets from a stack, in accordance with the principles of the invention.
FIG. 2 is a schematic view of an alternative expedient for maintaining a stack of sheets at a constant height so that the top sheets may be fed from the stack by the magnetically coupled rollers.
FIG. 3 is a sectional view through magnetically coupled rollers showing the flux path of the magnetic lines of force holding the rollers together.

Referring to FIG. 1, there is shown a bin 10 containing a stack 11 of sheets 12 which may be sheets of paper or laminates such as printed circuit boards. Resting on the top of sheet is a freely mounted first roller 13 constructed of a paramagnetic material such as steel. The roller 13 may be in the form of a hollow cylinder that may be coated with a high friction grit. Such a construction finds particular utility when the sheets to be fed are light in weight (e.g., paper). In the alternative, when the sheets are heavy, such as in the case of printed circuit boards, the hollow cylinder may be filled with lead.

Engaging the roller 13 is a second roller 14 constructed of a material that is susceptible of being permanently magnetized. The roller 14 is axially magnetized to present a north magnetic pole 16 at one end, see FIG. 3, and a south magnetic pole at the other end 17. The radius of the roller 14 is selected so that the nadir of the periphery is at a distance X from the surface of the top sheet 12. The diameter of the first roller 13 is selected to be greater than the distance X. A shaft 18 driven by a motor or other drive device (not shown) provides a mounting for the roller 14.

When the shaft 18 and the roller 14 are driven in a clockwise direction, the magnetically attracted first roller 13 is rotated in a counter-clockwise direction to frictionally engage and peel off the top sheet 12 from the stack 11. As the sheets are successively fed from the stack, the freely supported roller drops under the force of gravity, but is held in engagement with the roller 14 by the magnetic force of the permanently magnetized second roller 14. Continued peeling off of the sheets causes the axis of the first roller 13 to swing in an arc towards a perpendicular line running orthogonally from the surface of the top sheet through the axis of the second roller 14. When the axis of the roller 13 is moved from a position forward of the perpendicular line to coincide with the perpendicular line, the roller 13 will be magnetically held to the roller 14 and will no longer engage the top sheet with sufficient force to continue the feeding of the sheets.

It will be noted that as the roller 14 rotates, the frictional force at the junction of the peripheries of the respective rollers 13 and 14 tends to move the roller 13 into the bite between the roller 14 and the top sheet 12, thereby forcing the roller 13 downwardly in frictional engagement with the top sheet. However, inasmuch as the roller 13 is freely mounted, the roller will not bind but will spin or rotate on the loose top sheet 12 to impart a feed force to thrust the sheet from the stack.

In order to ensure a continuous feed of the sheets, a stack lifting arrangement is provided. More specifically, a sensor 21 is mounted on the bin and includes a spring-urged feeler arm 22 that bears on the topmost sheet 12. As the stack 11 is depleted, the feeler arm 22 accordingly drops, and after a drop of predetermined distance, a switch 23 is closed to complete an energizing circuit to a drive unit or motor (not shown) which is effective to rotate a gear 24 that meshes with a rack 26 on which is secured an elevator platform 27 supporting the stack 11 of sheets. The switch 23 and feeler arm 22 are set so that the feeler arm actuates the switch at a time slightly before the time that the axis of the roller 13 moves into coincidence with the perpendicular line running from the top of the upper sheet 12 through the axis of the magnetized drive roller 14. When the gear 24 is rotated the elevator platform 27 moves upwardly to lift the stack 11. As the stack rises, the feeler arm 22 moves upwardly and the switch 23 is set to open when the stack is lifted to the original height.

If an attending operator happens to place a finger in the nip between the rollers 13 and 14, the magnetically held roller 13 will move away from the drive roller thus preventing injury to the operator. The magnetizing force utilized need only be of such magnitude as to ensure contact between the rollers, and hence the magnetization is not that strong so as to preclude the easy separation of the roller 13 from the roller 14.

The sheets are fed seriatim from the stack 11 down a ramp 28 to a second set of magnetically coupled rollers 31 and 32 which function to further feed the sheets in a direction along a guideway 35 to one or more utilization devices (not shown) such as a printer or stamping device. Sheets exiting from the utilization device are advanced to a further roller feed device comprising a pair of rollers 33 and 34.

The rollers 33–34 differ from the previously described roller feeds in that the first roller 33 is positioned on the opposite side of or behind the perpendicular line running from the surface of the guideway 35 through the axis of the second roller 34. Again the roller 34 is driven in a clockwise direction to impart a counterclockwise rotation to the roller 33 to again feed the sheet in the same direction as the other pairs of rollers 13–14 and 31–32. However, in this instance, the roller 33 is not frictionally urged into the bite between the nadir of periphery of the roller 34 and the surface of the guideway 35. In fact, the rotation of the roller 34 engages the roller 33 with a force tending to thrust the roller 33 from the bite. However, the magnetic force is sufficient to maintain the contact between the rollers, and as a result the roller 33 is rotated to frictionally engage and feed sheets advanced into the nip between the roller 33 and the surface of the guideway 35.

An advantage of this arrangement of rollers resides in increased safety to the attending operator. If the operator's finger or clothing is caught in the niip between the rollers 33 and 34, the magnetically held roller 33 will more easily separate from the drive roller 34. It will be appreciated that in instances where the maximum drive force is to be attained, the roller arrangement depicted by the rollers 13 and 14 and rollers 31 and 32 may be utilized. However, where the drive rollers are exposed and there is some possibility of an attending operator placing a finger in the nip between the rollers, then the embodiment illustrated by the rollers 33 and 34 may be utilized.

If a still greater drive force is required, both rollers of each set may be individually magnetized with the north-/south magnetic axes extending in opposite directions such as depicted in FIG. 3. In this instance, the driving roller such as roller 14, is again magnetized as previously described, and the first roller 13 is axially magnetized in an opposite direction in that an end 36 is magnetized to present a south magnetic pole, whereas the opposite end 37 is magnetized to present a north magnetic pole. In this instance, the lines of flux of the respective magnetized rollers function to assist each other and create a strong magnetic coupling between the rollers.

An alternative bin and elevator arrangement is shown in FIG. 2. In this instance, a bin 41 is loaded with a stack 11 of sheets 12 which may be in the form of printed circuit boards. The stack 11 is supported on an elevator platform 42 secured to a piston rod 43 emanating from an air cylinder 44. Constant air pressure is imparted to the air cylinder 44 to provide a lifting force to the stack 11 which is urged upwardly so that the uppermost laminate 12 abuts against two series of rollers 46 and 47 rotatably mounted on shafts projecting inwardly from the opposite side walls of the bin 41. Again a pair of feed rollers 13 and 14 are utilized to strip the printed circuit boards from the stack. As a board is extracted and fed from the stack, the pressurized air cylinder 44 moves the elevator platform 42 and the stack 11 upwardly so that contact is maintained with the rollers 46 and 47.

Other magnetizing expedients may be utilized to effectuate the magnetic coupling between the rollers, such as contructing the drive roller 14 from a paramagnetic material and permanently magnetizing the roller 13. A further embodiment contemplates the use of an electromagnet within the drive roller instead of a permanent magnetization of the drive roller. In this instance, a magnetized coil 15 is mounted in the roller 14 and is energized by a power source 19 via a commutator device 20.

What is claimed is:

1. An apparatus for feeding a sheet, which comprises:

a first magnetized drive roller;

a shaft for rotatably mounting the first roller with the nadir of its periphery at a predetermined distance from a sheet to be fed; and a freely supported second roller constructed of paramagnetic material and interposed between the sheet and the first roller and in magnetic contact coupling with the first roller, said second roller having a diameter greater than said predetermined distance so that it rests on the sheet to be fed, magnitude of the magnetic coupling force between the rollers being selected to maintain driving contact therebetween during the feeding of the sheet by the second roller and to enable separation of the second roller away from the first roller in the presence of any object in the nip between said rollers.

2. An apparatus as defined in claim 1 wherein the second roller constructed of paramagnetic material is also magnetized.

3. An apparatus as defined in claim 2 wherein the first roller is axially magnetized with a magnetic axis extending in a first direction, and the second roller is axially magnetized with a magnetic axis extending in an opposite direction.

4. An apparatus as defined in claim 1 wherein the first roller is rotated to exert a force tending to drive the second roller into the gap between the periphery of the first roller and the sheet to be fed thereby downwardly forcing the rotating second roller in frictional engagement with said sheet.

5. An apparatus as defined in claim 1 wherein the first roller is rotated to exert a force tending to drive the second roller from the gap between the periphery of the first roller and the sheet to be fed, said first roller being magnetized to such an extent as to hold the second roller against the periphery of the first roller thereby rotating the second roller to frictionally engage and feed said sheet.

6. An apparatus as defined in claim 1 wherein the magnetized roller is permanently magnetized.

7. An apparatus as defined in claim 1 wherein the magnetized roller is electrically magnetized.

8. An apparatus for feeding a sheet, which comprises:

a drive shaft;

a first roller mounted on said shaft, said first roller having a predetermined radius which is less than the distance between the center line of the shaft and the top surface of a sheet to be fed; said first roller being constructed of a magnetized material;

a freely supported second roller having a diameter greater than the distance between the sheet and the periphery of the first roller and constructed of paramagnetic material so that said second roller abuts against the periphery of the first roller and rests on the top surface of a top sheet of a stack of sheets to be fed while being magnetically held against the first roller, the magnetic coupling force between the rollers being selected to maintain driving contact therebetween while the sheet is being fed by the second roller and to enable separation of the second roller away from the first roller in the presence of any object in the nip between the rollers; and means for continuously rotating the shaft to rotate the first roller which in turn rotates the second roller magnetically coupled thereto to feed successive sheets from the stack engaged by only said second roller while the freely supported second roller drops under the force of gravity and its rotational axis arcuately swings towards a perpendicular line running orthogonally from the surface of the top sheet through the axis of rotation of the first roller.

9. An apparatus as defined in claim 8, which comprises:

an elevator mechanism for supporting the stack;

means for sensing the depletion of a predetermined number of sheets from the stack; and means rendered effective upon sensing a predetermined depletion of sheets from the stack for operating the elevator mechanism to lift the stack and push the second roller from the gap between the first roller and the top sheet of the stack.

10. An apparatus as defined in claim 9 wherein said elevator operating means is operated prior to the movement of the axis of the second roller into coincidence with the line running orthogonally from the surface of the sheet and the axis of rotation of the first roller.

11. An apparatus as defined in claim 10 which comprises:

means for continuously urging the stock upwardly; and means for limiting the upward movement of the stock to maintain the top sheet at the same elevation.

12. A method of feeding a sheet which comprises:

freely supporting a first paramagnetic roller on the sheet;

engaging the first roller with a second magnetized drive roller that is spaced from the sheet by a distance smaller than the diameter of the first roller;

establishing a magnetic field to attract the rollers toward each other while gravity holds the first roller on the sheet;

selecting the magnitude of the magnetic field to maintain driving contact between the rollers while the sheet is being fed and to enable the first roller to readily separate away from the second roller in the presence of any object in the nip therebetween; and rotating the second drive roller to rotate the magnetically contacted first roller to feed the sheet engaged by only the first roller.

13. A method as set forth in claim 12 wherein the sheet is a top sheet of a stack of sheets, which comprises:

elevating the stack upon feeding of a predetermined number of sheets from the stack.

14. A method as set forth in claim 12, which comprises:

placing the first roller on the surface of the sheet forward in the direction of feed of a line running orthogonally from said surface through the axis of the second roller; and rotating the second roller to exert a force tending to drive the magnetically coupled first roller into the gap between the periphery of the second roller and the surface of the sheet to be fed.

15. A method as set forth in claim 12, which comprises:

placing the first roller on the surface of the sheet behind in the direction of feed of a line running orthogonally from said surface through the axis of the second roller; and rotating the second roller to exert a force tending to drive the magnetically coupled first roller from the gap between the periphery of the second roller and the surface of the sheet to be fed.

* * * * *